US006884027B2

(12) United States Patent
Faulkner

(10) Patent No.: US 6,884,027 B2
(45) Date of Patent: Apr. 26, 2005

(54) SEALING OF TURBOMACHINERY CASING SEGMENTS

(75) Inventor: Andrew Rowell Faulkner, Lutterworth (GB)

(73) Assignee: Alstom Technology Ltd., Baden (CH)

( * ) Notice: Subject to any disclaimer, the term of this patent is extended or adjusted under 35 U.S.C. 154(b) by 79 days.

(21) Appl. No.: 10/634,028

(22) Filed: Aug. 4, 2003

(65) Prior Publication Data

US 2004/0151582 A1 Aug. 5, 2004

(30) Foreign Application Priority Data

Aug. 3, 2002 (GB) ..... 0218060

(51) Int. Cl.[7] ..... F01D 11/22
(52) U.S. Cl. ..... 415/173.3; 415/174.2
(58) Field of Search ..... 415/134, 135, 415/139, 173.1, 173.3, 173.4, 173.5, 174.2

(56) References Cited

U.S. PATENT DOCUMENTS 4,127,357 A 11/1978 Patterson
4,330,234 A * 5/1982 Colley ..... 415/173.2
4,332,523 A * 6/1982 Smith ..... 415/173.3
4,787,817 A * 11/1988 LaGrange et al. ..... 415/173.4
4,863,345 A * 9/1989 Thompson et al. ..... 415/174.1
6,672,831 B1 * 1/2004 Brandl et al. ..... 415/173.2

FOREIGN PATENT DOCUMENTS

EP 0 808 991 A2 11/1997

* cited by examiner

*Primary Examiner*—Edward K. Look
*Assistant Examiner*—Igor Kershteyn
(74) *Attorney, Agent, or Firm*—Kirschstein et al.

(57) ABSTRACT

A sealing arrangement for sealing around a turbine or compressor blade includes casing segments having sealing faces for abutting with opposing sealing faces of circumferentially adjacent casing segments along joints between the segments. The sealing faces on adjacent segments are forced into contact with each other by rotation of each casing segment about a mounting pin. To reduce radial leakage, a sealing plate is provided.

8 Claims, 2 Drawing Sheets

SEALING OF TURBOMACHINERY CASING SEGMENTS

FIELD OF THE INVENTION

The present invention relates to sealing arrangements in turbomachinery, and in particular to sealing arrangements for improving sealing between adjacent casing segments surrounding the rotor blades of axial flow compressors and turbines.

DESCRIPTION OF THE RELATED ART

The turbomachinery industry is continuously striving to reduce motive fluid leakage between rotating and static components. One place where leakage typically occurs in axial flow machines is through the gaps between the radially outer ends of turbine or compressor rotor blades and the surrounding static casing.

FIG. 1 illustrates the case of a gas turbine in which each rotor blade 2 (or circumferentially adjacent group of blades) is provided with a shroud portion 13 attached to, or formed integrally with, the blade's outer tip 12. Each shroud portion, of course, comprises a segment of a shroud annulus which extends completely around the rotor. In such a case, it is common practice to reduce over-shroud leakage in the direction of the dashed arrows by providing the outer surfaces of the shroud segments 13 with one or more sealing ribs or fences 14. The fences 14 confront and co-operate with sacrificial collar features 16 made of abradable material and mounted on the surrounding casing 4. During normal operation of the turbine, the turbine is designed to have a small gap (typically about 1 mm) between the radially outer tips of the fences 14 and the inner diameter of the confronting abradable material. However, during start-up, shutdown, or other transient conditions, the diameter of the rotor may vary within limits relative to the casing 4 due to differential thermally- and centrifugally-induced expansion and contraction. This may cause the radially outer tips of the fences to contact the abradable collars 16 and wear them away to form grooves which house the tips of the fences. The presence of the abradable material thus ensures that the clearance between the shroud fences 14 and the casing can be maintained at a desirable minimum.

To accommodate differential thermal expansion, it is necessary to divide the casing 4 into a number of circumferentially consecutive casing segments 5. Adjacent casing segments butt up against each other at axially and radially extending joints that, in the present example, run parallel to the longitudinal axis of the turbine or compressor. The casing segments may be held in position, e.g., by engagement of their axially opposed edges in grooves or channels 6, 8 formed in axially adjacent fixed portions of the turbine comprising the outer fixings of adjacent upstream and downstream stator blades 15, 17, respectively.

The abutting faces 18 of the casing segments 5 each have a groove for receiving the edge of a corresponding strip seal 20, which thereby seals the joint between adjacent casing segments. Unfortunately, it has been found that in spite of the presence of the strip seal, there is still a significant amount of radial and axial leakage of the turbine motive fluid through the gaps between the casing segments.

Alternatives to the use of strip seals between casing segments are therefore being sought in an effort to reduce leakage of turbine or compressor passage fluid through the joints between the segments.

SUMMARY OF THE INVENTION

The present invention provides axial fluid flow turbomachines with a sealing arrangement in the form of a casing assembly comprising a plurality of casing segments arranged in circumferential sequence, wherein circumferentially adjacent casing segments abut each other along generally radially extending joints, each casing segment having circumferentially opposed ends and each of its opposed ends comprising at least one sealing face for abutting with a corresponding sealing face on a circumferentially adjacent segment, each casing segment being mounted for limited pivoting movement about a pivot point, whereby pivoting movement of the casing segments causes the sealing faces to come into sealing contact with each other.

The circumferentially opposed ends of the casing segments can advantageously be stepped in the circumferential direction, with the sealing faces extending circumferentially. By this is meant that each end of each segment has at least one planar sealing face orientated generally perpendicular to both the circumferential and longitudinal directions to form one or more rebates.

To co-operate sealingly with the casing segments, shrouded turbine or compressor blade are preferably provided with at least one sealing fence to reduce the axial leakage between the blade shroud and the casing segment. If only a single fence is provided, then each opposed end of the casing segment preferably has a single planar sealing face orientated generally perpendicular to the circumferential direction to form a single rebate, the sealing face being preferably axially aligned with the fence so that the casing segment provides a circumferential overlap along the line of the fence.

If the tip of the turbine or compressor blade is provided with two sealing fences, then each end of the casing segment preferably has two such planar sealing faces to form a double rebate and provide a circumferential overlap along the line of each fence. It will be readily appreciated that further fences and rebates can be provided in the same manner.

In an alternative form of the invention, the planar sealing faces can be oriented obliquely with respect to the circumferential direction. For instance, the casing segments, if viewed in a radially inward direction (i.e., if seen in plan view), may be generally shaped like a parallelogram, though the sealing faces could alternatively be arcuate when seen in plan view. In any case, for efficient sealing between adjacent casing segments, the present invention demands that the sealing faces of the joint between them should run transversely of the longitudinal axis of the turbine or compressor.

In the case of two or more shroud fences of differing radial height, a radially inner surface of each casing segment is stepped in the radial direction to accommodate the shape of the shroud fences.

A radially outer surface of the casing segment preferably further includes a pivot point, such as a pivot pin, about which the casing segment can pivot. The pivot point is preferably positioned such that a pressure differential across the casing segment causes the casing segment to rotate about the pin. Alternatively, the casing segment can be made to rotate about the pin by any other suitable means, such as a cam mechanism. This rotation forces the sealing faces of adjacent casing segments into contact with each other and provides a better seal along the joint between adjacent casing segments than if the adjacent segments were simply butted up against each other. For example, if the joint is stepped then this rotation forces the sealing faces orientated generally perpendicular to the circumferential direction of the turbine or compressor into contact with each other. Because the adjacent casing segments are rotating in opposed directions, the seal between the planar face or faces is particularly efficient and greatly reduces axial leakage.

To reduce radial leakage the casing assembly preferably includes a sealing plate mounted in sealing relationship (contact or near contact) on the radially outer surface of the casing segment and extending circumferentially over the joint between the casing segment on which the sealing plate is mounted and an adjacent casing segment. The sealing plate is preferably mounted on the pivot point provided on the radially outer surface of the casing segment.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
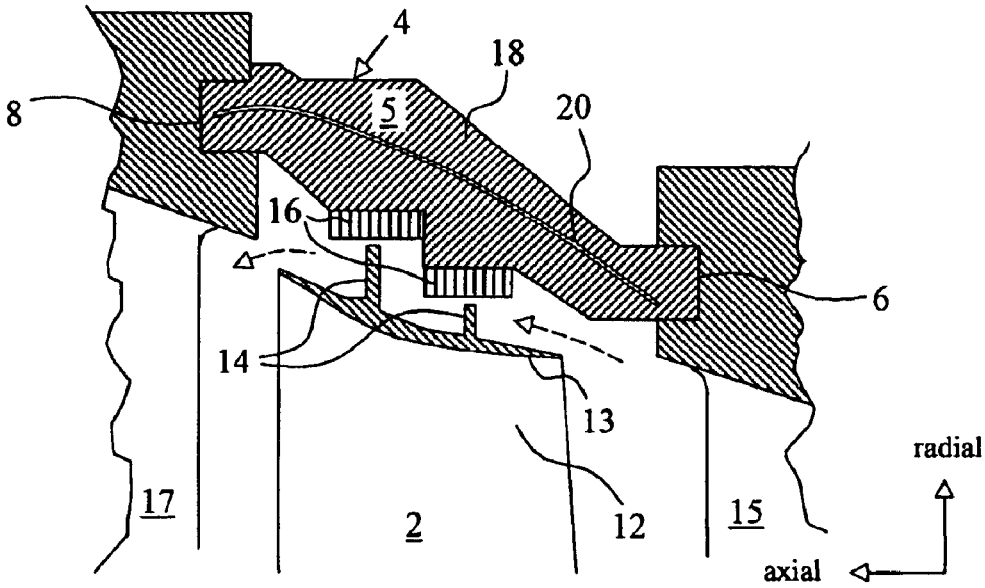
Figure 1 (Prior Art)
FIG. 1 is a partial cross sectional side view of a known sealing arrangement between a shrouded turbine blade and a surrounding turbine casing.

As already described, a known type of sealing arrangement between a shrouded turbine blade 2 and the turbine casing 4 is shown in FIG. 1. The sealing fences 14 on the shroud 13 of the turbine blade 2 are axially aligned with two annular strips of abradable material 16 to accommodate differential expansion/contraction during operation of the gas turbine engine and maintain a minimum clearance between the shroud and the casing segments 5. Strip seals 20 span the joints between confronting faces 18 of adjacent casing segments 5 to control leakage. They also help to keep adjacent casing segments 5 in registration with each other.

Figure 2:
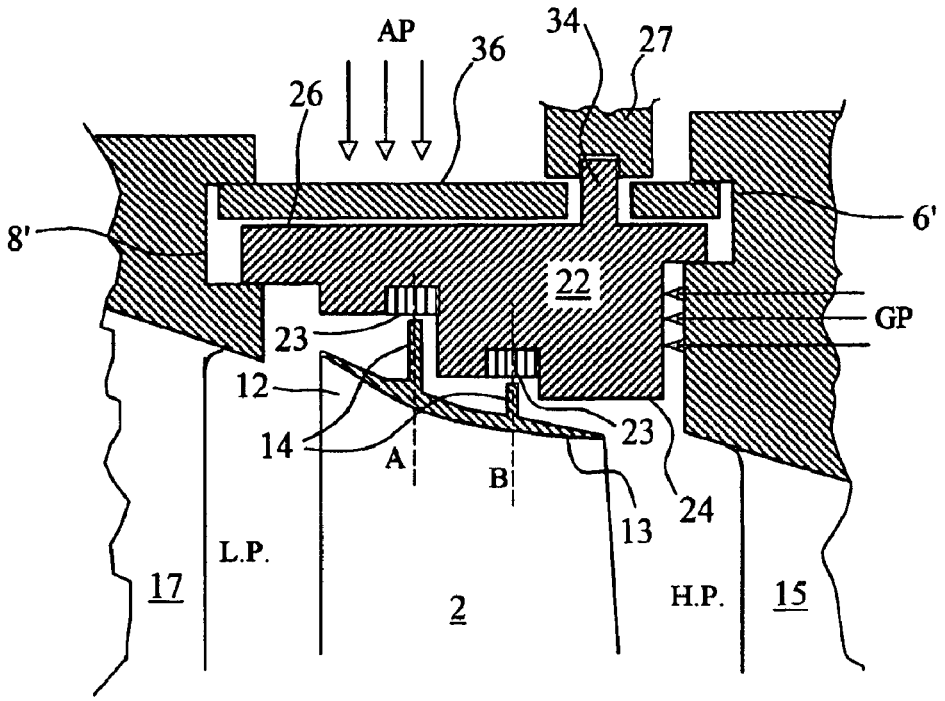
FIG. 2 is a similar cross sectional view of a sealing arrangement according to the present invention.
Figure 3:
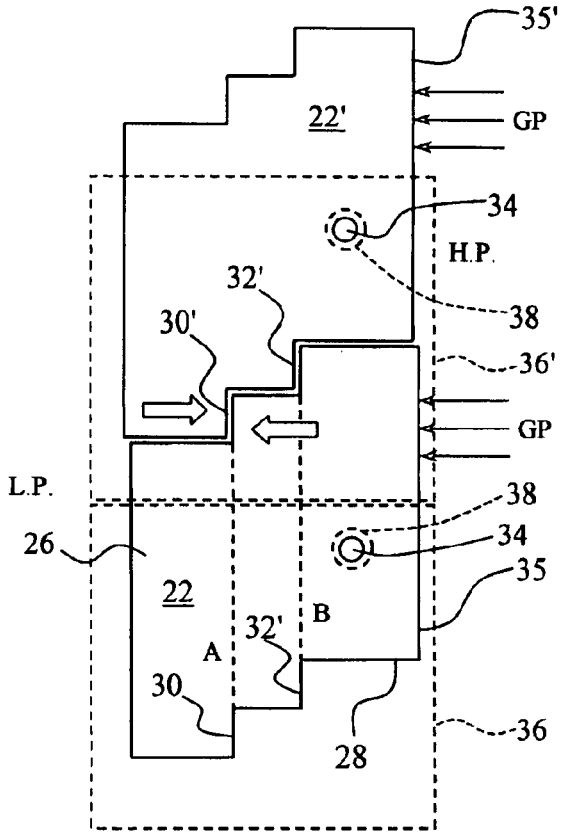
FIG. 3 is a plan view of a pair of casing segments of FIG. 2.
Figure 4:
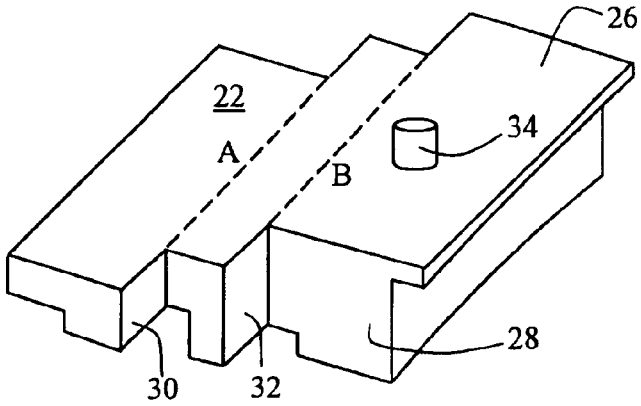
FIG. 4 is a perspective sketch showing a casing segment of FIG. 2.

FIGS. 2 to 4 show a sealing arrangement in accordance with a first embodiment of the present invention. A plurality of casing segments 22 and 22' are circumferentially arranged around a shrouded turbine blade 2 to provide a seal in conjunction with shroud fences 14 between the low-pressure (L.P.) and high-pressure (H.P.) sides of the turbine blades 2. Abradable linings 23 can be fitted to confront the shroud fences 14. In this example of the invention, the linings 23 are fitted as inserts in grooves of the casing segments.

The turbine blade 2 and its shroud are unchanged from FIG. 1, and similarly to FIG. 1, the casing segments 22 and 22' have a radially stepped radially inner surface 24, which in the circumferential direction follows the curve of the turbine annulus. However, the casing segments have a planar radially outer surface 26. Furthermore, where the casing segments 22 and 22' butt up against each other along generally radially extending joints, their confronting side faces 28 are also circumferentially stepped as shown in FIGS. 3 and 4. The casing segments 22 and 22' are stepped to provide a circumferential overlap at the nominal axial positions (A and B) of the fences 14, so that they have two planar sealing faces 30 and 32 (as further described below) that lie along the line of the fences 14.

Plainly, in a case where only one shroud fence 14 is provided at, say, axial position A, there will only be a single circumferential step corresponding to the fence, the step also coinciding with axial position A to form the sealing faces 30, 30'. Similarly, if three shroud fences 14 were to be provided, there would advantageously be three corresponding circumferential steps in each joint of the casing segments.

The radially outer surface 26 of each shroud segment 22, 22' has a mounting pin 34 which co-operates with fixed structure 27 on part of an outer turbine casing (not shown) to prevent the casing segments 22 and 22' from moving circumferentially around the turbine. The pins 34 are positioned off-center relative to the circumferentially extending dimensions of the high-pressure sides 35, 35' of the casing segments 22, 22', such that the gas pressure GP acting on the high-pressure side of the casing segments causes them to pivot slightly in the directions shown by the block arrows in FIG. 3. This pivoting movement forces the two planar sealing faces 30 and 32 of the first casing segment 22 into sealing contact with the two planar sealing faces 30' and 32' of the second casing segment 22' to thereby reduce leakage through the joint between the segments.

To further reduce radial leakage, sealing cover plates 36, 36' are provided on top of the casing segments 22, 22' as shown in FIGS. 2 and 3. The sealing plates 36, 36' are each provided with a hole 38 for mounting on a corresponding mounting pin 34 and are dimensioned to completely cover the joint between the segment on which the sealing plate is mounted and the circumferentially adjacent segment. It is arranged that during operation of the turbine, cooling air pressure AP maintains each sealing plate 36 in sealing relationship with (i.e., in contact with, or in close proximity to) the casing segments. However, it will be evident to the skilled person that due to the need to follow the curvature of the turbine annulus, the outer surfaces of the casing segments will collectively form a many-sided polygon, and therefore, e.g., while the force exerted by pressure AP will cause the radially inner side of sealing plate 36' to contact, or nearly contact, the radially outer side of casing segment 22', there will be a slightly greater gap between the radially inner side of plate 36' and the radially outer side of casing segment 22.

To prevent possible binding between the various relatively moving surfaces of the casing segments, the sealing plates, and the fixed structure, it may be desirable to provide such surfaces with low friction coatings, as known in the art. Alternatively, or in addition, some of the cooling air pressure AP could be allowed to bleed through small holes (not shown) in the sealing plates and produce an air flotation effect between the radially inner side of plates 36, 36' and the radially outer side of casing segments 22, 22'. This would also have the desirable effect of providing greater active cooling of the sealing plates and the casing segments.

Figure 5:
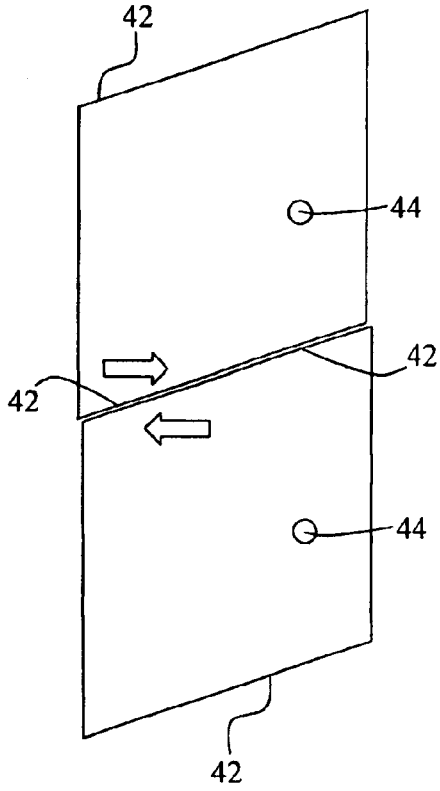
FIG. 5 is a plan view showing a pair of alternative casing segments according to the invention.

FIG. 5 illustrates an alternative pair of casing segments 40 and 40'. The casing segments 40 and 40' are butted up against each other and have sealing side faces 42 that are planar rather than stepped and are oriented obliquely with respect to the circumferential direction, i.e., are skewed with respect to the axial direction. In other respects, including provision of seal plates (not shown), the casing segments 40 and 40' are similar to the casing segments 22 and 22' in FIGS. 2 to 4, each pivoting about a mounting pin 44 to produce a seal along their sealing faces.

It will be understood that each of the elements described above, or two or more together, also may find a useful application in other types of constructions differing from the types described above.

While the invention has been illustrated and described as embodied in sealing of turbomachinery casing segments, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. In an axial fluid flow turbomachine, a casing assembly comprising: a plurality of casing segments arranged in circumferential sequence, wherein circumferentially adjacent casing segments abut each other along generally radially extending joints, each casing segment having circumferentially opposed ends and each of its opposed ends comprising at least one sealing face for abutting with a corresponding sealing face on a circumferentially adjacent segment, each casing segment being mounted for limited pivoting movement about a pivot point, whereby pivoting movement of the casing segments causes the sealing faces to come into sealing contact with each other.

2. The casing assembly according to claim 1, wherein the circumferentially opposed ends of the casing segments are stepped in a circumferential direction, and wherein the sealing faces extend circumferentially.

3. The casing assembly according to claim 1, wherein the sealing faces are obliquely oriented with respect to a circumferential direction.

4. The casing assembly according to claim 1, wherein a radially inner surface of the casing segment is stepped in a radial direction.

5. The casing assembly according to claim 1, wherein the pivot point is provided on a radially outer surface of each casing segment.

6. The casing assembly according to claim 5, wherein the pivot point is positioned off-center with respect to the circumferential extent of the casing segment, whereby an axial pressure differential across the casing segment causes the casing segment to rotate about a pin.

7. The casing assembly according to claim 1, in which each casing segment has mounted thereon a sealing plate in sealing relationship therewith, the sealing plate being located radially outwards of the casing segment and extending circumferentially over the joint between the casing segment on which the sealing plate is mounted and an adjacent casing segment.

8. The casing assembly according to claim 7, wherein the sealing plate is mounted on the pivot point of the casing segment.

* * * * *